US008333244B2

(12) United States Patent
Johnson et al.

(10) Patent No.: US 8,333,244 B2
(45) Date of Patent: Dec. 18, 2012

(54) BOTTOM TAG FOR PROGRESSING CAVITY PUMP ROTOR WITH COILED TUBING ACCESS

(75) Inventors: Nicholas D. Johnson, Claremore, OK (US); Douglas W. Berry, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 427 days.

(21) Appl. No.: 12/604,715

(22) Filed: Oct. 23, 2009

(65) Prior Publication Data

US 2011/0094730 A1 Apr. 28, 2011

(51) Int. Cl.
*E21B 43/00* (2006.01)

(52) U.S. Cl. ..... 166/369; 417/360; 418/48

(58) Field of Classification Search ..... 166/68, 166/105, 369, 370; 417/360; 418/48
See application file for complete search history.

(56) References Cited

U.S. PATENT DOCUMENTS

| | | | | |
|---|---|---|---|---|
| 1,892,217 | A | 12/1932 | Moineau | |
| 2,028,407 | A | 1/1936 | Moineau | |
| 4,059,165 | A * | 11/1977 | Clark | 175/107 |
| 5,209,294 | A | 5/1993 | Weber | |
| 5,549,160 | A * | 8/1996 | Bownes et al. | 166/250.08 |
| 5,611,397 | A * | 3/1997 | Wood | 166/68 |
| 5,725,053 | A | 3/1998 | Weber | |
| 6,338,388 | B1 * | 1/2002 | Winkler | 166/382 |
| 6,695,060 | B1 * | 2/2004 | Guidry et al. | 166/370 |
| 7,201,222 | B2 | 4/2007 | Kanady et al. | |
| 2006/0048934 | A1 * | 3/2006 | Charabin | 166/177.7 |
| 2009/0136371 | A1 | 5/2009 | Gerling | |

* cited by examiner

*Primary Examiner* — Daniel P Stephenson
*Assistant Examiner* — Kipp Wallace
(74) *Attorney, Agent, or Firm* — Steve Rosenblatt

(57) ABSTRACT

The bottom tag of the present invention comprises a tapered coupling that is secured below the stator housing. In one embodiment the smaller diameter of the coupling is smaller than the rotor minor diameter. In another embodiment the smallest diameter in the coupling tag is smaller than the major diameter of the rotor and longer than one half the rotor pitch, so that no more than one half of a rotor pitch can enter. In either case there are optional side openings to aid flow during operation. The taper in the coupling tag guides coiled tubing through when the rotor is removed to clean up the wellbore below by jetting through the coiled tubing. The taper can also guide measurement equipment through.

19 Claims, 2 Drawing Sheets

BOTTOM TAG FOR PROGRESSING CAVITY PUMP ROTOR WITH COILED TUBING ACCESS

FIELD OF THE INVENTION

The field of the invention is Moineau progressing cavity pumps for subterranean use, driven by rods powered from the surface, and more particularly to a feature that facilitates rotor alignment with the stator where the tag shoulder is positioned below the stator and permits access below with coiled tubing when the rotor is removed.

BACKGROUND OF THE INVENTION

Progressing cavity pumps (PCP) were invented in the 1930s by Moineau as seen in U.S. Pat. Nos. 1,892,217 and 2,028,407.

A progressing cavity pump has a stator and a rotor. The stator typically comprises an elastomeric liner within a housing. The stator is open at both ends and has a multi-lobe helical passage extending through it. The rotor is normally of metal and has a helical exterior. Rotating the rotor causes fluid to pump through the stator. Progressing cavity pumps are used for a variety of purposes.

As a well pump, progressing cavity pumps may be driven by a downhole electrical motor or by a string of rods extending to a motor located at the surface. With a rod driven pump, normally the stator is suspended on a string of tubing, and the drive rods are located within the tubing. When installing a rod driven progressing cavity pump, the operator first secures the stator to the string of tubing and runs the tubing into the well to a desired depth. The operator then lowers the rotor through the tubing on the string of rods and into the stator.

To operate the pump at desired capacity, the rotor must be at the desired axial spacing within the stator and the rods must be in tension. If the lower end of the rotor is spaced above a lower end of the stator during operation, then a lower portion of the stator will not be in engagement with the rotor and the pumping capacity will suffer. The operator thus needs to know when the rotor has fully entered the stator during installation. The operator can calculate how much the rods will stretch due to the hydrostatic weight of the column of well fluid in the tubing. With the anticipated stretch distance known and with the rotor at a known initial position in the stator, the operator can pull the rods and rotor upward a distance slightly greater than the anticipated stretch, so that during operation, the rotor will move back downward to the desired axial position relative to the stator.

In the prior art, prior to running the tubing, the operator secures or welds a tag bar across the bottom of the stator. During installation, downward movement of the rods will stop when the lower end of the rotor contacts the tag bar at the bottom of the stator. Upon tagging the bar, the operator pulls the rod string back toward the surface by the calculated amount of rod stretch. During operation, as well fluid fills the tubing, the rod stretches, allowing the rotor to move back downward until in full engagement with the stator. If installed properly, once the rods have stretched fully, the lower end of the rotor will be spaced above the tag bar and the rods will be in tension.

While this method works well enough, tag bar creates an obstruction at the bottom of the pump. The obstruction prevents the operator from lowering tooling or instruments through and below the pump for logging, tagging fill, and other monitoring related purposes. Other problems with this approach are the obstruction to flow during operation, and the tendency of sand and well debris to accumulate around the tag bar and clog the intake.

U.S. Pat. No. 7,201,222 teaches of a tag method in which the tag location is an interference shoulder above the pump. The tag shoulder is located above the stator in a reduced diameter collar connected to the tubing, while the rotor tag is connected to the rod string above the rotor. When the rotor is lowered down and reaches its appropriate location relative to the stator, the stop on the rotor rod string interferes with the reduced diameter collar located above the stator in the tubing string, preventing the rotor from progressing further into the stator. While some of the above issues were overcome with this method, there was still the issue of proper placement of the tag bar with respect to the stator. To avoid the eccentric rotation of the rotor, proper distance had to be placed between the tag area and the top of the stator. As the tag location on the collar has to match up directly with the tag location on the rotor rod string, long, precision equipment would be required, as well as specialized equipment to prevent the stop on the rotor rod string from damaging the tubing as the rod string rotated. In addition, this method would present more flow obstruction problems, now moved from below the pump to above the pump.

Similarly, U.S. Publication 2009/0136371 suggests a method that lowers the tag surface to the very top of the stator, by shaping the pass through hole in the tag collar located in the tubing string above the stator or integral with the stator, in such a way that the rotor eccentric motion would not cause the rotor to contact the through hole. More simply, the opening is shaped like the stator helical cavity, so as the collar is placed directly above the stator and timed correctly, the rotor should operate freely in the collar. The rotor head would then locate on what would be the minor diameter of the collar through hole. To avoid damage from heat if welding was used to secure the tag bar above the stator, there still needed to be a substantial spacing between the stator top and the tag bar. If connections that were threaded were used instead there were still placement issues could exist. A threaded connection was difficult to properly torque while still winding up with the needed alignment of the oblong openings. If the thread had to be backed up after being torqued to align the stator and collar openings then the torque for the connection was reduced which risked the connection getting subsequently undone while the pump was in service.

Also relevant to issues of rotor placement are U.S. Pat. Nos. 5,209,294 and 5,725,053.

The present invention addresses the issues with bottom tag bar systems of the past by forming the bottom tag where it can stop rotor movement for alignment purposes but at the same time provide a passage through it for tubing access for cleanup of the wellbore when the rotor is pulled. The passage in the tag device can be made small enough to refuse the rotor minor diameter or larger so that the major diameter provides the travel stop for the rotor generally after advancing the length of half the rotor pitch. Those skilled in the art will more readily appreciate further aspects of the invention from a review of the detailed description of the preferred embodiment and the associated drawings while understand that the appended claims delimit the full scope of the invention.

SUMMARY OF THE INVENTION

The bottom tag of the present invention comprises a tapered coupling that is secured below the stator housing. In one embodiment the smaller diameter of the coupling is smaller than the rotor minor diameter. In another embodiment the smallest diameter in the coupling tag is smaller than the major diameter of the rotor so that no more than one half of a rotor pitch can enter. In either case there are optional side openings to aid flow during operation. The taper in the coupling tag guides coiled tubing through when the rotor is removed to clean up the wellbore below by jetting through the coiled tubing.

DETAILED DESCRIPTION OF THE PREFERRED EMBODIMENT

Figure 1:
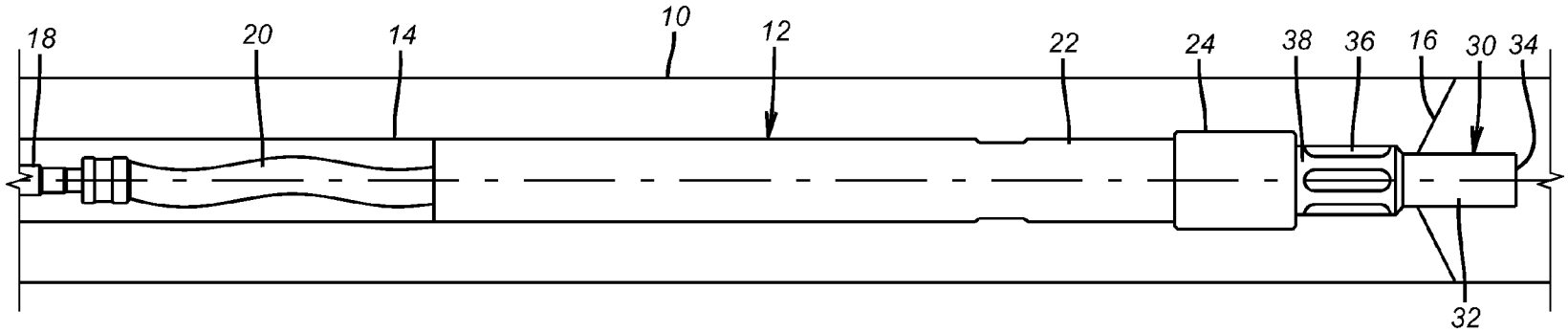
FIG. 1 is a view of the progressing cavity pump positioned in the wellbore with a bottom tag coupling.

FIG. 1 illustrates a wellbore 10, which is most likely a cased hole, where a stator 12 has been delivered on tubing 14 and secured by the schematically illustrated anchor 16. After the positioning of the stator 12 a rotor 20 is lowered through the tubing 14 by an operating rod assembly 18. Those skilled in the art will appreciate that the rotor 20 has to be properly positioned with respect to the stator 12 in which the rotor 20 will be rotated by the operating rod assembly 18 that is powered at the surface of the wellbore 10. The basics of progressing cavity pumps as far as the construction of the rotor 20 and the stator 12 are not the focus of the present invention. Rather it is the way the rotor 20 is stopped when inserted for subsequent relative positioning with respect to the surrounding stator 12 that is the main focus of the present invention.

Figure 4:
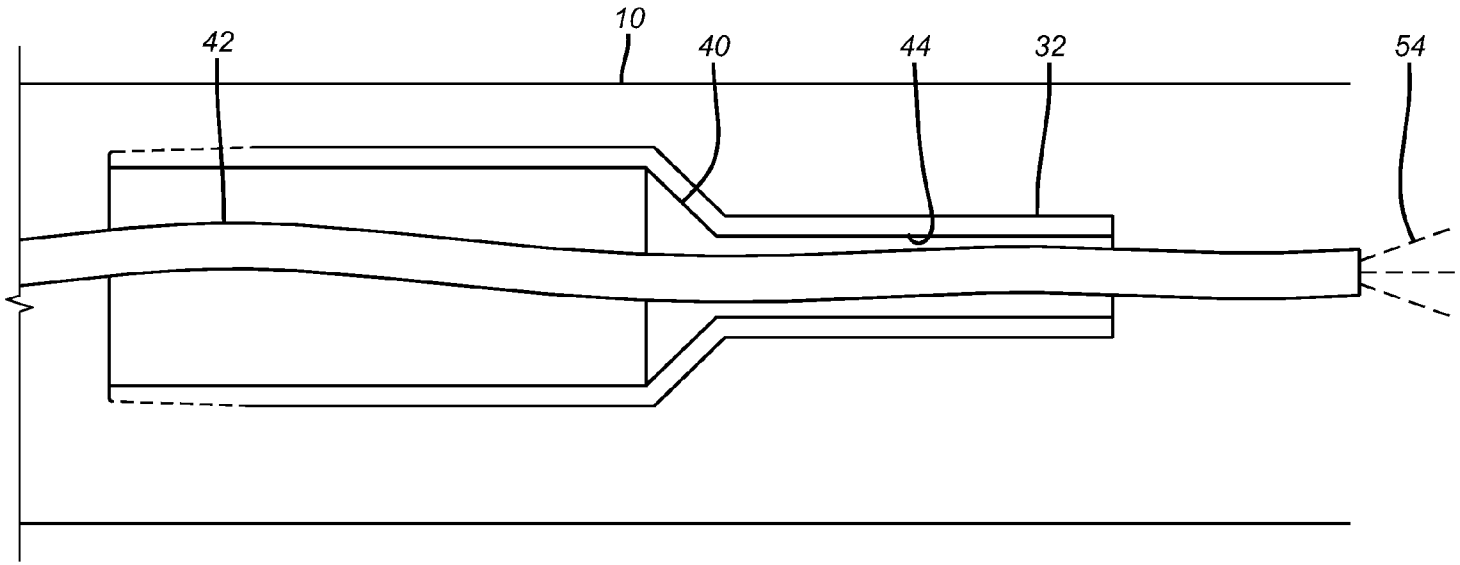
FIG. 4 shows the rotor removed from the stator and coiled tubing inserted into the bottom tag coupling to jet out the wellbore.

The stator 12 comprises a housing 22 with a coupling 24 that is threaded at opposed ends at 26 and 28. FIG. 1 shows a bottom tag coupling 30 that comprises a tubular lower end 32 having a lower end inlet 34 and one or more apertures 36 in an upper housing 38 secured at thread 28 to the coupling 24. Coupling 30 can be pinned to stator 12 instead of threaded. There is a taper 40 as the transition between the lower end 32 and the upper housing 38. Taper 40 serves as a guide to the coiled tubing 42 that can be inserted into lower end 32 after the rotor 20 is pulled out with the rod assembly 18, as shown in FIG. 4. Apertures 36 provide enhanced inlet flow area to the end inlet 34 to reduce flow resistance into the pump when the rotor 20 is rotated.

Figure 2:
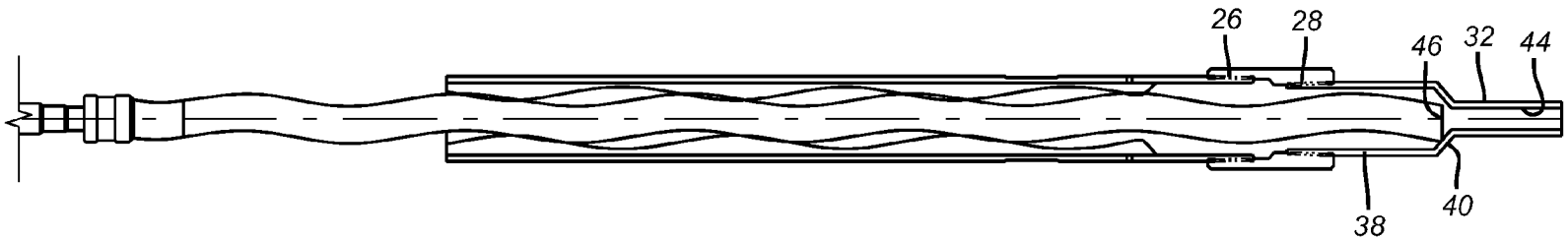
FIG. 2 is the view of FIG. 1 partly in section showing a preferred embodiment of said bottom tag coupling.
Figure 3:
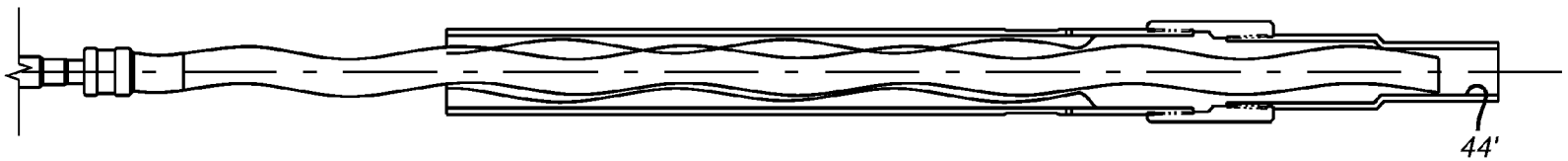
FIG. 3 shows an alternative embodiment of the bottom tag coupling.
Figure 5:
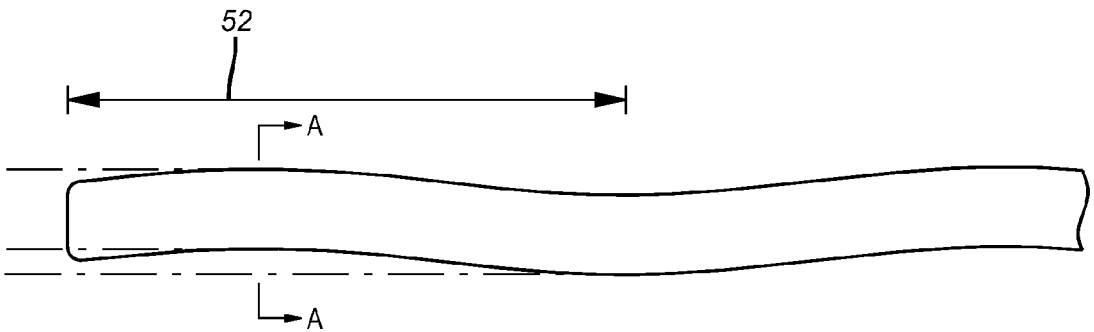
FIG. 5 shows a rotor end with a reference line at A-A to illustrate the definition of the major and minor diameters of the rotor.
Figure 6:
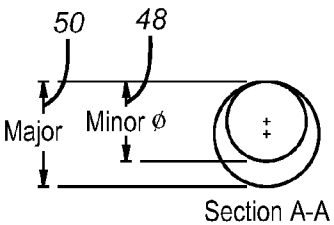
FIG. 6 is a companion view of FIG. 5 to illustrate at the location of line A-A the definition of the rotor major and minor diameters.

The diameter of passage 44 in lower end 32 can be configured in two ways as shown in FIGS. 2 and 3. In FIG. 2 the diameter at 44 is less than the dimension at the lower end 46 of the rotor 20 so that no part of the rotor 20 can advance beyond the taper 40. Another way to say this is that the diameter of passage 44 does not exceed the minor diameter of the rotor 20. FIGS. 5 and 6 illustrate the minor diameter with arrow 48 and the major diameter with arrow 50. Both these terms are well known in the art of progressing cavity pumps.

FIG. 3 illustrates a larger optional passage 44' which is smaller than the major diameter 50 so that one half of a pitch of rotor 20, represented by arrow 52 in FIG. 5, can enter passage 44' before further travel is stopped. This option requires that the length of the reduced diameter extension be at least ½ the rotor pitch length long. The advantage of the FIG. 3 embodiment is an increase in flow area, but also that ultimately when the rotor 20 is pulled a larger diameter coiled tubing 42 can be run in with a jet fitting 54 to clean debris from the bottom of the wellbore 10. It should be noted that advancing the rotor 20 through the stator 12 somewhat centralizes the rotor 20 as it advances into the lower tag assembly 30 to help insure that when the rotor 20 stops advancing that it is at the half of one pitch extension into passage 44'. Note that passage 44 or 44' can be concentrically aligned with the housing 22 or somewhat offset from the center of housing 22.

Depending on the embodiment employed as between FIG. 2 or 3 the amount of distance that the rod assembly 18 is picked up after landing on the bottom tag assembly 30 is factored in.

The bottom tag assembly 30 can be welded to the housing 22 or made integral to it. The material for assembly 30 can be any material strong enough to handle the weight of the rotor 20 and the rod assembly 18. The assembly 30 can be metallic, composite or fiberglass to name a few examples. The apertures 36 can be in any shape or arrangement so long as the structural integrity of the assembly 30 is maintained. The apertures 36 preferably have a greater cross sectional area than the end inlet 34. The additional inlet flow area prevents starving the pump with too much inlet flow resistance. The taper 40 is optional and a flat transition can be used although the taper is preferred for subsequent guiding the coiled tubing 42 for jetting below the stator 12. Instruments can also be lowered through the stator 12 either on coiled tubing or wireline. Rigid tubing can also be used instead of coiled tubing 42 but coiled tubing has the advantage of a faster trip into and out of the well 10.

The above description is illustrative of the preferred embodiment and many modifications may be made by those skilled in the art without departing from the invention whose scope is to be determined from the literal and equivalent scope of the claims below.

We claim:

1. A progressing cavity pump for subterranean use such as in a wellbore, comprising:

a rotor rotatably mounted in a stator;

a stationary bottom tag assembly supported by said stator and having a passage therethrough and at least one lateral opening with a portion of said passage preventing advance of said rotor for an indication of initial rotor positioning prior to said rotor being repositioned from a position in direct contact with the passage to an operating position out of contact with said passage, said at least one lateral opening located between an upper end of said bottom tag assembly and said portion of said passage preventing advance of said rotor.

2. The pump of claim 1, wherein:

said rotor has a minor diameter and said portion of said passage is smaller than said minor diameter.

3. The pump of claim 1, wherein:

said rotor has a major diameter and said portion of said passage is smaller than said major diameter.

4. The pump of claim 1, wherein:

said lateral opening has an area at least as large as said passage.

5. The pump of claim 1, wherein:

said passage is larger than coiled tubing to allow the coiled tubing to be advanced through it with the rotor removed, for cleaning the wellbore.

6. The pump of claim 1, wherein:

said bottom tag assembly has a taper to reduce the size of said passage from a larger dimension located closer to said stator.

7. The pump of claim 6, wherein:

said taper is concentric with said stator.

8. The pump of claim 6, wherein:

said taper is eccentric with said stator.

9. The pump of claim 1, wherein:

said passage is larger at an end of said bottom tag assembly closer to said stator and transitions to a smaller dimension that engages said rotor for a travel stop.

10. The pump of claim 3, wherein:

said rotor has a predetermined pitch and a length representing no more than one half of a pitch will fit into said passage before its travel stops.

11. The pump of claim 1, wherein:

said passage has an entrance and said entrance acts as a travel stop for said rotor.

12. The pump of claim 1, wherein:

a diameter of said rotor allows said passage to stop the travel of said rotor.

13. The pump of claim 1, wherein:

said rotor is made of a metallic, composite or fiberglass material.

14. The pump of claim 1, wherein:

said bottom tag assembly is threaded or pinned to said stator.

15. The pump of claim 1, wherein:

said bottom tag assembly is welded to or integral to said stator.

16. The pump of claim 1, wherein:

said rotor is supported by a rod assembly as it is rotated in said stator;

said bottom tag assembly can support the weight of said rotor and said rod assembly.

17. The pump of claim 14, further comprising:

a threaded coupling between said stator and said bottom tag assembly.

18. The pump of claim 3, wherein:

said portion of said passage is longer than half the rotor pitch length.

19. The pump of claim 1, wherein:

said passage is larger than coiled tubing to allow the coiled tubing to be advanced with instruments through it with the rotor removed.

* * * * *